US008165787B2

(12) United States Patent
Reed et al.

(10) Patent No.: US 8,165,787 B2
(45) Date of Patent: Apr. 24, 2012

(54) METHOD FOR ADJUSTING ENGINE AIR-FUEL RATIO

(75) Inventors: Dennis Craig Reed, Dexter, MI (US); Bruce Colby Anderson, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/083,101

(22) Filed: Apr. 8, 2011

(65) Prior Publication Data

US 2011/0213547 A1 Sep. 1, 2011

(51) Int. Cl.
*F02D 41/30* (2006.01)
*F01N 3/00* (2006.01)

(52) U.S. Cl. ..... 701/109; 60/285

(58) Field of Classification Search ..... 701/109, 701/108, 103–105; 60/276, 277, 278, 285; 123/672, 674, 676, 679
See application file for complete search history.

(56) References Cited

U.S. PATENT DOCUMENTS 4,809,501 A 3/1989 Kayanuma et al.
4,887,576 A 12/1989 Inamoto et al.
5,119,629 A 6/1992 Kume et al.
5,220,905 A 6/1993 Lundahl
5,255,662 A * 10/1993 Nakajima ..... 60/276
5,363,648 A 11/1994 Akazaki et al.
5,515,826 A 5/1996 Hamburg et al.
5,598,703 A 2/1997 Hamburg et al.
5,715,796 A 2/1998 Suzuki et al.
5,927,260 A 7/1999 Kishimoto et al.
5,953,910 A 9/1999 Sato et al.
6,119,447 A 9/2000 Eriksson et al.
6,233,922 B1 5/2001 Maloney
6,446,429 B2 * 9/2002 Kobayashi et al. ..... 60/285
6,591,605 B2 7/2003 Lewis
7,059,115 B2 6/2006 Yasui

FOREIGN PATENT DOCUMENTS

JP 2002089318 A * 3/2002

OTHER PUBLICATIONS

Jones, James C. Peyton et al., "A Pulse Width Modulation Control Scheme for Three-Way Catalyst Systems," Center for Nonlinear Dynamics and Control, Villanova University, 6th IFAC Sympsoium Advances in Automotive Control (2010), 6 pages.

* cited by examiner

*Primary Examiner* — Hieu T Vo
(74) *Attorney, Agent, or Firm* — Julia Voutyras; Alleman Hall McCoy Russell & Tuttle LLP

(57) ABSTRACT

A method for adjusting an air-fuel ratio of an engine is disclosed. In one example, the engine air-fuel ratio is adjusted in response to a duty cycle and frequency of a post catalyst oxygen sensor. The method may improve catalyst efficiency.

20 Claims, 4 Drawing Sheets

METHOD FOR ADJUSTING ENGINE AIR-FUEL RATIO

FIELD

The present description relates to a method and system for adjusting engine air-fuel ratio. The method may be particularly useful for engines that include one or more catalysts located in an exhaust system of the engine.

BACKGROUND AND SUMMARY

Catalysts are commonly coupled to engine exhaust systems for reducing regulated engine emissions. The catalysts may be configured with different coatings to promote catalyst efficiency and reduce catalyst light off time (e.g., the amount of time it takes for a catalyst to reach a predetermined efficiency). However, even with higher performance catalyst coatings, it can be important to control engine exhaust gases entering the catalyst or the catalyst efficiency may degrade.

In U.S. Pat. No. 6,591,605 catalyst efficiency may be improved by adjusting engine air-fuel ratio via feedback from a combination of a time varying signal and an output of a post catalyst oxygen sensor. However, if there is an error between the output of the post catalyst oxygen sensor and the time varying signal, a single error adjustment term simultaneously accounts for errors in amplitude, phase, and frequency. As a result, adjusting the engine air-fuel ratio for a phase error in the post catalyst oxygen sensor output may cause an undesirable disturbance in the amplitude and/or frequency of the post catalyst oxygen sensor output. Consequently, it may be somewhat difficult for the output of the post catalyst oxygen sensor to converge to the time varying signal during some operating conditions.

The inventors herein have recognized the above-mentioned disadvantages and have developed a method for improving engine air-fuel control. One example of the present description includes a method for adjusting an air-fuel ratio of an engine, comprising: adjusting an air-fuel ratio applied to engine cylinders via a frequency adjustment and a duty cycle adjustment, the frequency and duty cycle adjustments based on a duty cycle and frequency of a signal derived from an oxygen sensor positioned downstream of a catalyst.

By adjusting an air-fuel ratio supplied to an engine via frequency and duty cycle adjustments, it may be possible for an output of a post catalyst oxygen sensor to converge to a desired response at a faster rate. In particular, when individual adjustments are made to an engine air-fuel ratio for frequency errors and/or duty cycle errors between the output of a post catalyst oxygen sensor and a predetermined signal, it may be possible to compensate for the errors with less affect on other signal attributes.

The present description may provide several advantages. Specifically, the approach may improve catalyst conversion efficiency. In addition, the approach may provide more consistent vehicle emissions since duty cycle errors can be compensated separately from frequency errors. Further, the approach provides for duty cycle and frequency adjustments for a broad range of operating conditions beyond basic engine operating conditions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 2:
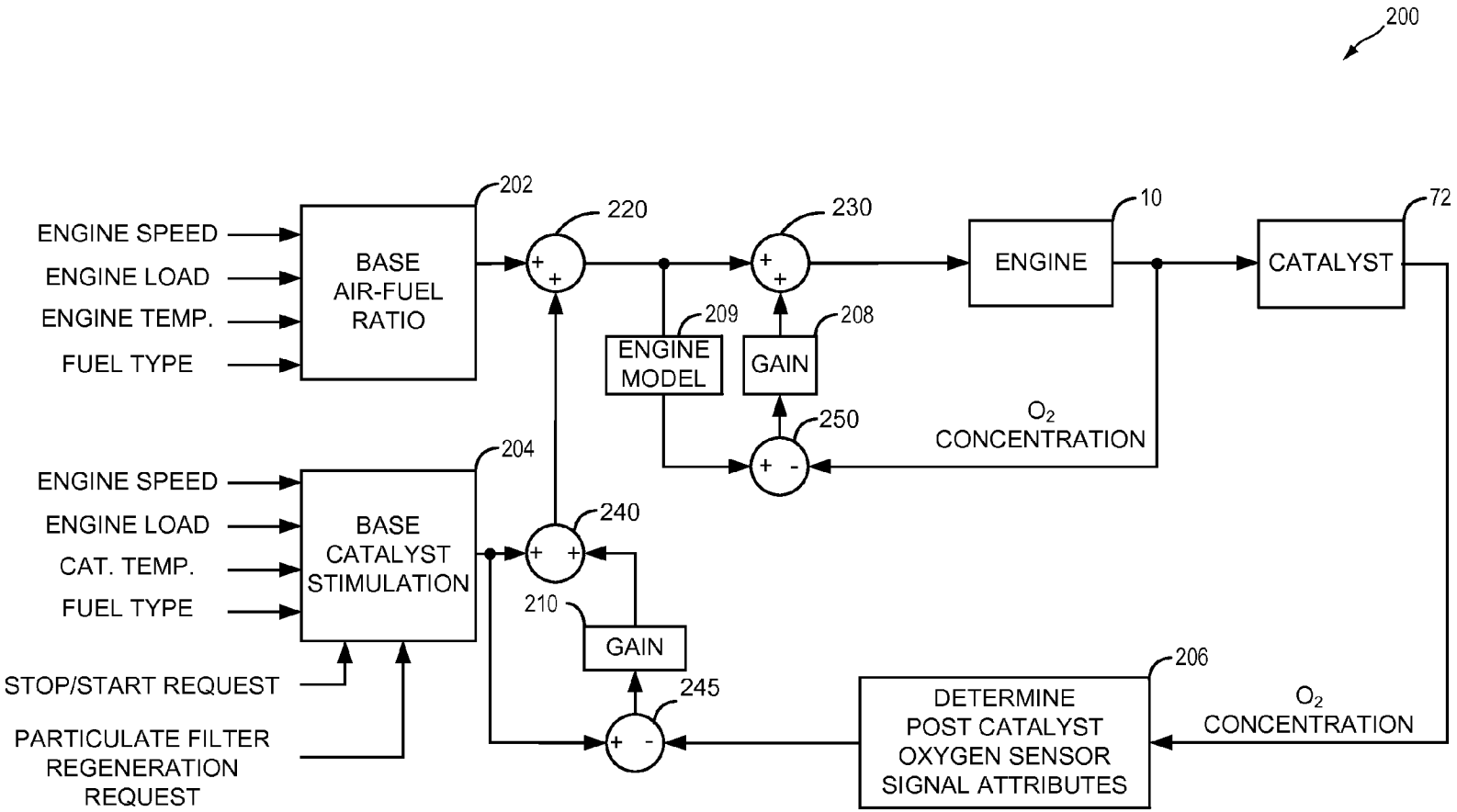
FIG. 2 shows a block diagram of an air-fuel control system.
Figure 3:
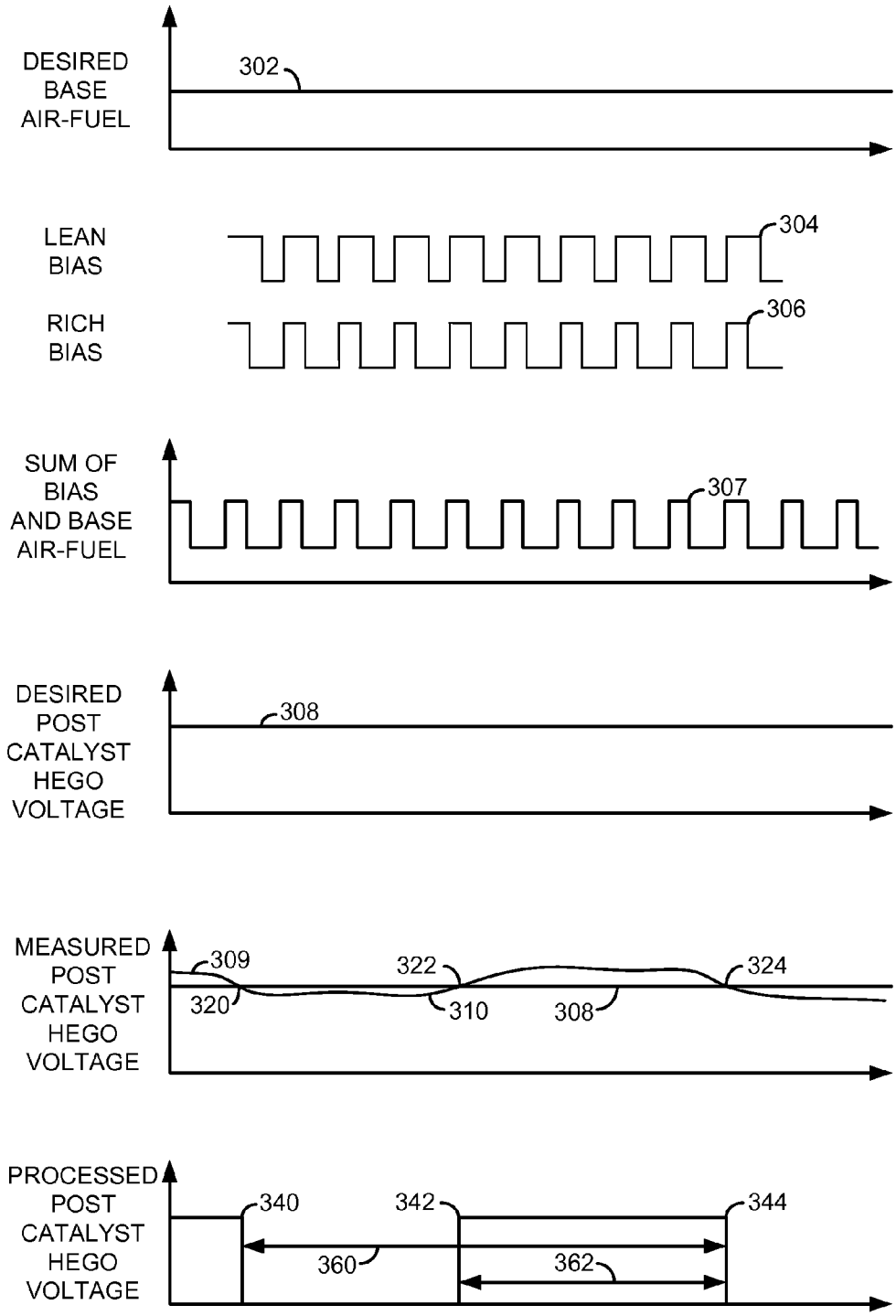
FIG. 3 is an example plot of signals of interest for adjusting an air-fuel ratio of an engine.
Figure 4:
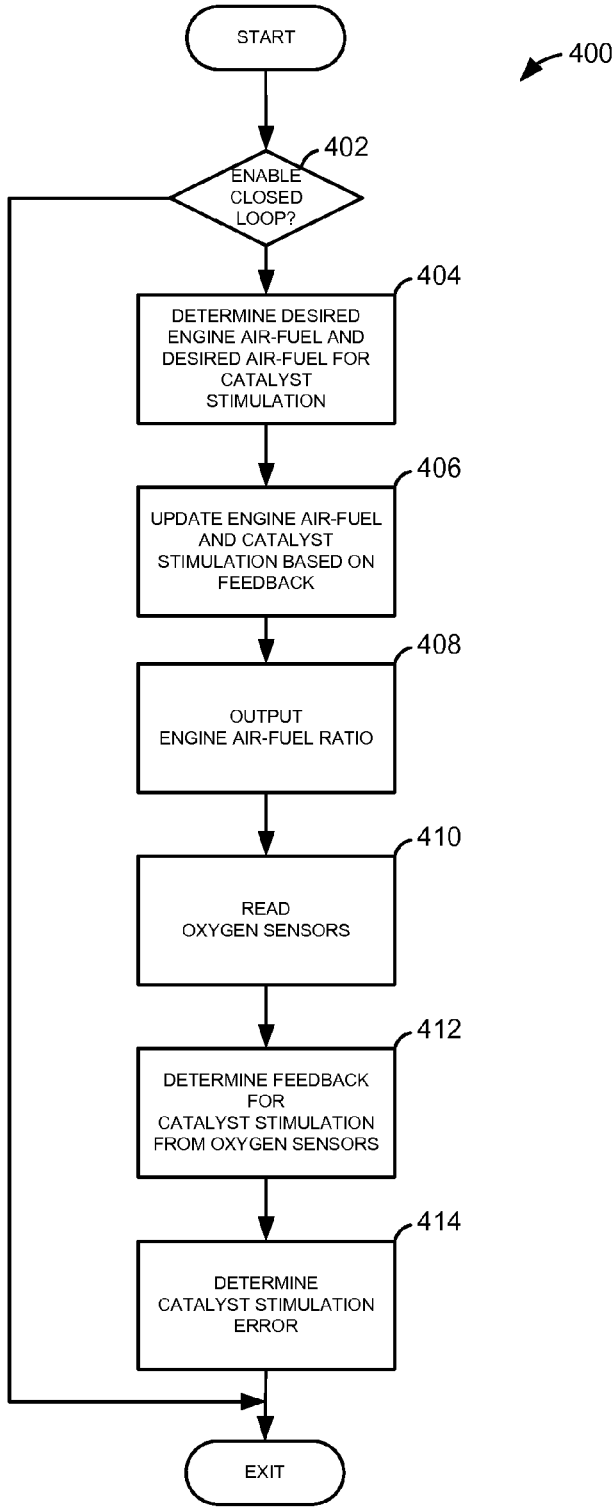
FIG. 4 is a flowchart of an example engine air-fuel control method.

The present description is related to adjusting an engine air-fuel ratio. In one non-limiting example, the engine may be configured as part of the system illustrated in FIG. 1. The engine air-fuel ratio may be adjusted via a controller as illustrated in FIG. 2. The system of FIG. 1 and the controller of FIG. 2 may combine to provide the signals illustrated in FIG. 3. The signals of FIG. 3 show how engine air fuel may be adjusted and how duty cycle and frequency information can be derived from output of a post catalyst oxygen sensor. FIG. 4 shows a method to adjust engine air-fuel ratio via executable instructions of the controller illustrated in FIG. 1.

Figure 1:
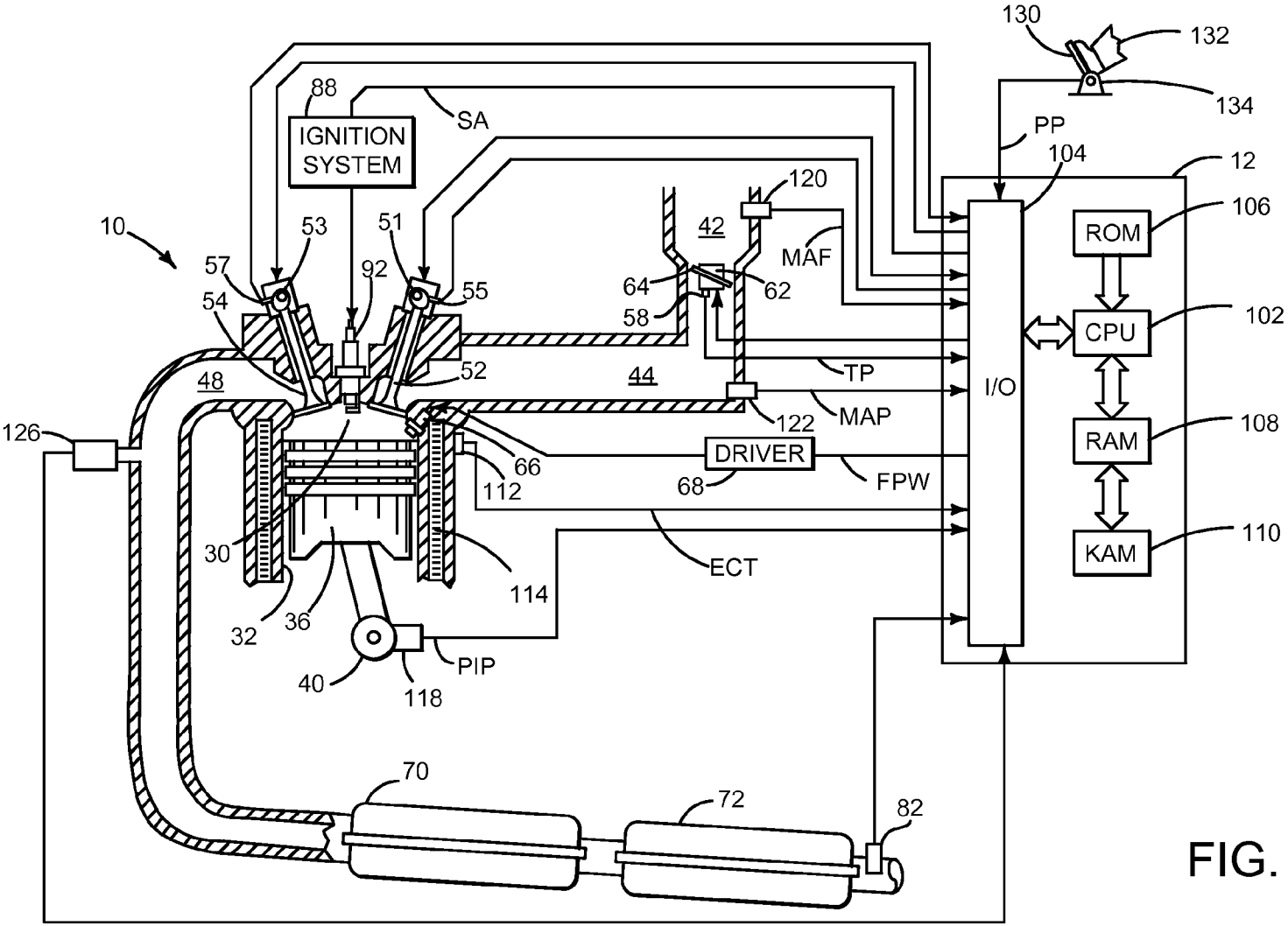
FIG. 1 is a schematic diagram of an engine.

Referring now to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from air intake 42 to intake manifold 44. In one example, a low pressure direct injection system may be used, where fuel pressure can be raised to approximately 20-30 bar. Alternatively, a high pressure, dual stage, fuel system may be used to generate higher fuel pressures.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 72. Alternatively, a two-state exhaust gas oxygen sensor may be substituted for UEGO sensor 126. A heated exhaust gas oxygen (HEGO) sensor 82 is shown positioned downstream of UEGO sensor 126. In other examples, a UEGO sensor may be substituted for HEGO sensor 82.

Particulate filter 70 is configured to store particulate matter for subsequent oxidation. In some examples, particulate filter may be constructed of a porous substrate. Catalytic converter 72 is shown positioned downstream of particulate filter 70 and can include multiple catalyst bricks, in one example. In another example, multiple emission control devices, each with multiple bricks, can be used. Converter 72 can be a three-way type catalyst in one example. In other examples, catalytic converter 72 may be positioned upstream of particulate filter 70.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof. Further, in some embodiments, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to TDC. Note that the above is shown merely as an example, and that intake and exhaust valve opening and/or closing timings may vary, such as to provide positive or negative valve overlap, late intake valve closing, or various other examples.

Referring now to FIG. 2, a block diagram of an air-fuel control system is shown. At 202, control system 200 determines a base engine air-fuel ratio. In one example, the base engine air-fuel ratio is stored in a table indexed by engine speed and load. The table is comprised of empirically determined air-fuel ratios that are suited for different engine speeds and loads. The base engine air-fuel ratio extracted from the table may be adjusted for engine temperature. For example, at lower engine temperatures the base engine air-fuel ratio may be richened to compensate for lower fuel volatility. In addition, the base engine air-fuel may be adjusted for different types of fuel. For example, the base air-fuel ratio for a warmed up engine may be 14.6:1 for gasoline while the base air-fuel ratio for a gasoline/alcohol fuel mixture may be 12.1:1. The base engine air-fuel ratio from 202 is directed to summing junction 220.

At 204, control system 200 determines base engine air-fuel ratio for catalyst stimulation. In one example, engine speed and load index two tables. The first table contains different frequencies for adjusting engine air-fuel ratio to stimulate the catalyst. The second table contains different duty cycles for adjusting engine air-fuel ratio. The combination of the output of the first table and the second table is an engine air-fuel modulation signal having a frequency and duty cycle. For example, 0.7 Hz at a 60% rich duty cycle where the duty cycle is the rich portion of the air-fuel modulation signal as is shown in FIG. 3. The base engine air-fuel ratio for catalyst stimulation may be further adjusted for catalyst temperature and fuel type. In one example, the frequency is increased and the rich portion of the duty cycle is lowered or decreased as catalyst temperature decreases. The higher frequency and lower or decreased rich portion of the duty cycle account for less available oxygen storage availability when the catalyst is cooler.

The base engine air-fuel ratio for catalyst stimulation may also be adjusted for an impending or on-going regeneration of a particulate filter. In one example, the lean portion of the duty cycle can be increased in response to a request for impending particulate filter regeneration. For example, if it is determined that the particulate filter should be regenerated by oxidizing soot held by the particulate filter, the lean portion of the base engine air-fuel ratio for catalyst stimulation can be adjusted to an increased lean duty cycle (e.g., 75% lean duty cycle). By leaning the base engine air-fuel ratio for catalyst stimulation, it may be possible to cycle a catalyst between rich and lean exhaust gases to provide efficient catalyst operation even when the particulate filter is consuming oxygen from the exhaust gas during regeneration. Once particulate filter regeneration is complete, the base engine air-fuel ratio for catalyst stimulation can be richened by increasing the rich portion of the duty cycle of the base engine air-fuel ratio for catalyst stimulation. Thus, the engine can be operated with an increased rich portion of the duty cycle for a predetermined amount of time before the engine is stopped.

In addition, the base engine air-fuel ratio for catalyst stimulation may also be adjusted for automatic engine stop/start conditions. For example, if engine and vehicle operating conditions are such that an automatic stop is going to be initiated or is predicted, the base engine air-fuel ratio for catalyst stimulation can increase the rich duty cycle so as to reduce the amount of oxygen stored in the catalyst just before the engine is automatically stopped. By reducing the amount of oxygen stored in the catalyst before engine stop, it may allow the catalyst to be in better condition for an engine restart because the catalyst may not be saturated with oxygen.

In some examples, the amplitude of the base engine air-fuel ratio for catalyst stimulation may also be adjustable and indexed from a table that is indexed by engine speed and load. The base engine air-fuel ratio for catalyst stimulation is directed from 204 to summing junctions 240 and 245. In one example, the base engine air-fuel ratio for catalyst stimulation is comprised of a frequency and a duty cycle. In another example, the base engine air-fuel ratio for catalyst stimulation is comprised of a frequency, amplitude, and duty cycle.

At 206, control system 200 determines feedback for correcting the base engine air-fuel ratio for catalyst stimulation from one or more post catalyst oxygen sensors. In one example, a frequency, duty cycle, and amplitude may be determined from the output of a post catalyst oxygen sensor as described in FIG. 3. In this way, the post catalyst oxygen sensor provides feedback to correct for variation in frequency, duty cycle, and amplitude of the base engine air-fuel ratio for catalyst stimulation. The output from 206 is directed to summing junction 245.

At summing junction 245, the frequency, duty cycle, and amplitude of the measured engine air-fuel ratio for catalyst stimulation is subtracted from base engine air-fuel ratio for catalyst stimulation to provide error terms for engine air-fuel ratio catalyst stimulation frequency, duty cycle, and amplitude. Each of the engine air-fuel ratio catalyst stimulation frequency, duty cycle, and amplitude errors are multiplied by a gain at 210. The gain may be a function of one or more variables including engine speed, engine load, and catalyst temperature. The gain may be linear or non-linear.

At summing junction 240, the base engine air-fuel ratio for catalyst stimulation is added to the error adjustment to the base engine air-fuel ratio for catalyst stimulation. Thus, the base engine air-fuel ratio for catalyst stimulation is increased or decreased depending on the error adjustment to the base engine air-fuel ratio. In particular, the amplitude, frequency, and duty cycle of the base engine air-fuel ratio for catalyst stimulation are revised at summing junction 240 via the error terms for amplitude, frequency, and duty cycle resulting from the determination of catalyst stimulation at 206.

At summing junction 220, the base engine air-fuel ratio is added to the adjusted base engine air-fuel for catalyst stimulation. The output of summing junction 220 is a desired engine air-fuel ratio defined by a frequency, amplitude, duty cycle, and DC offset. The output of summing junction 220 is directed to 209 and summing junction 230. At 209 a model of the engine is provided so that the desired and actual engine signals may be aligned at summing junction 250. The output of engine model 209 is routed to summing junction 250.

At summing junction 250, a measured engine air-fuel ratio as determined from output of an oxygen sensor is subtracted from the modeled engine output derived from the desired engine air-fuel ratio to provide an engine air-fuel ratio error. The engine air-fuel ratio error is directed to gain 208 where the engine air-fuel error is multiplied by a gain. The gain may be linear or non-linear and may be a function of engine speed, engine load, and catalyst temperature. The engine speed and load provide an indication of mass flow rate through the catalyst. Gain output 208 is directed to summing junction 230.

At summing junction 230, the desired engine air-fuel ratio and the desired engine air-fuel ratio error are added together to provide a commanded engine air-fuel ratio. The commanded engine air-fuel ratio may be output via a fuel injector and/or an adjustment of a throttle. In one example, the engine air-fuel ratio is richened by increasing a fuel pulsewidth. The engine air-fuel ratio may be leaned by decreasing the fuel pulsewidth. The engine air amount may be determined from a desired engine torque demand and the mass of air entering the engine may be divided by the desired air-fuel ratio to provide the amount of fuel to be injected to the engine. In other examples, a lambda value may be substituted for engine air-fuel ratio. The engine air-fuel ratio is output to engine 10 via a combination of adjusting the engine throttle and adjusting engine fuel injectors. Engine 10 combusts the injected fuel and outputs exhaust gas to catalyst 72. Exhaust gas oxygen content is feedback to summing junction 250 and 206 to provide engine air-fuel or lambda feedback.

Thus, the system of FIGS. 1 and 2 provides for adjusting an engine air-fuel ratio, comprising: a first oxygen sensor positioned in an exhaust passage of an engine; a catalyst positioned in the exhaust passage of the engine; a second oxygen sensor positioned in the exhaust passage downstream of the catalyst; and a controller, the controller including instructions to adjust an air-fuel ratio of the engine responsive to a duty cycle and frequency of an output of the second oxygen sensor, the duty cycle and frequency output of the second oxygen sensor based on a desired post catalyst oxygen sensor voltage. The system further comprises a particulate filter positioned in the exhaust system. The system further comprises additional controller instructions to adjust the desired post catalyst oxygen sensor voltage based on engine operating conditions. The system also includes where the additional controller instructions include increasing the desired post catalyst oxygen sensor voltage in response to increasing engine load. The system further comprises additional controller instructions for a first mode where engine air-fuel is not adjusted in response to the second oxygen sensor and a second mode where engine air-fuel is adjusted in response to the second oxygen sensor. The system also includes where the second mode is a closed-loop fuel control mode, and further comprising additional controller instructions for delaying adjusting the air-fuel ratio of the engine in response to the second oxygen sensor and in response to a temperature of the catalyst.

Referring now to FIG. 3, an example plot of signals of interest for adjusting an air-fuel ratio of an engine is shown. The signals of FIG. 3 may be provided via the system of FIG. 1 and the methods of FIGS. 2 and 4.

The first plot from the top of FIG. 3 is a plot of desired engine air-fuel ratio versus time. The Y axis represents desired base engine air-fuel ratio. The X axis represents time and time increases from the left to the right side of the plot. Line 302 represents a stoichiometric air-fuel ratio. Above line 302 represents a lean condition and below line 302 represents a rich condition. In this example, the base engine air-fuel ratio is a stoichiometric air-fuel ratio (e.g., 14.6 for gasoline). The engine emissions may be efficiently converted to $H_2O$ and $CO_2$ when the engine is operated with a near stoichiometric air-fuel mixture.

The second plot from the top of FIG. 3 shows an example lean bias signal 304. A stoichiometric air-fuel mixture resides half way between the high and low portions of signal 304. Signal 304 is a lean biased because it has a greater proportion of the signal above or lean of a stoichiometric air-fuel mixture.

The third plot from the top of FIG. 3 shows an example rich bias signal 306. Similar to the second plot, a stoichiometric air-fuel mixture resides half way between the high and low portions of signal 306. Signal 306 is rich biased because it has a greater proportion of the signal below or rich of a stoichiometric air-fuel mixture.

Thus, it can be observed from the second and third plots that a rich or lean air-fuel mixture bias may be incorporated into a signal that has a constant frequency. In some examples, the rich or lean fuel bias can also be increased by increasing the rich or lean amplitude of the signal.

The fourth plot from the top of FIG. 3 shows a sum of the desired base air-fuel from the first plot from the top of FIG. 3 and the rich bias from the third plot from the top of FIG. 3. The Y axis represents engine air-fuel ratio. The X axis represents time and time increases from the left to the right side of the plot. Notice that signal 307 of the plot oscillates about a stoichiometric air-fuel ratio and is at a low level for a greater proportion of the time. Such an engine air-fuel ratio can improve efficiency of a catalyst by alternatively supplying oxygen and oxidants to the catalyst.

The fifth plot from the top of FIG. 3 shows an example desired average post catalyst HEGO voltage. The X axis represents post catalyst HEGO voltage and the Y axis represents time. Time begins on the left of the plot and increases to the right side of the plot. In the present example, line 308 represents a constant desired post catalyst HEGO control setting of 0.6 volts. In other examples, the desired post catalyst HEGO voltage may vary with engine and/or catalyst operating conditions and may contain hysteresis.

The sixth plot from the top of FIG. 3 shows an output voltage of a post catalyst HEGO sensor 309 relative to a desired average post catalyst HEGO control setting 308. The Y axis represents post catalyst HEGO voltage and the X axis represents time. Time increases from the left to the right side of the plot.

The seventh plot from the top of FIG. 3 shows a processed post catalyst HEGO voltage. The Y axis represents HEGO state relative to a desired post catalyst desired average post catalyst HEGO control setting. The X axis represents time and time increases from the left to right side of the plot. A high signal indicates a rich HEGO signal with respect to the desired average post catalyst HEGO control setting and a low signal indicates a lean HEGO signal with respect to the desired average post catalyst HEGO control setting.

The sixth and seventh plots are related in as far as the signals of the sixth plot are the basis of the signal in the seventh plot. At a time before post catalyst HEGO sensor signal 309 crosses the desired average post catalyst HEGO control setting 308, the HEGO sensor signal is above the desired average post catalyst HEGO control setting and indicates a rich condition with respect to the desired average post catalyst HEGO control setting in terms of exhaust gas constituents. After post catalyst HEGO sensor signal 309 crosses the desired average post catalyst HEGO control setting, the post catalyst HEGO sensor signal 309 is lean with respect to the desired average post catalyst HEGO control setting.

The post catalyst HEGO sensor signal 309 crosses the desired average post catalyst HEGO control setting at 320, 322, and 324. The level of the processed post catalyst HEGO voltage changes at each threshold crossing. For example, the threshold crossing at 320 corresponds to the level shift at 340. Similarly, the threshold crossings at 322 and 324 correspond to the level shifts at 342 and 344. The processed post catalyst HEGO signal indicates a rich condition when post catalyst HEGO signal 309 is rich of the desired average post catalyst HEGO control setting 308. The processed post catalyst HEGO signal indicates a lean condition when post catalyst HEGO signal 309 is lean of the desired average post catalyst HEGO control setting 308. The HEGO signal period may be determined via measuring the time between processed post catalyst HEGO edges. For example, arrow 360 indicates the time between high edges of the processed post catalyst HEGO voltage, or the period of the processed post catalyst HEGO signal. The frequency of post catalyst HEGO signal 309 about the desired average post catalyst HEGO setting 308 can be determined from the period. The rich duty cycle portion of the processed post catalyst HEGO voltage can be determined via measuring the time of leader 362. And, the rich duty cycle can be determined via the ratio of time represented by arrow 360 to the time represented by arrow 362.

It should also be noted that amplitude of the HEGO signal 309, relative to the desired average post catalyst HEGO, may be provided between each threshold crossing. In one example, the highest HEGO voltage between the HEGO sensor signal 309 and the desired average post catalyst HEGO control setting 308 may be output as HEGO rich side amplitude when the HEGO signal 309 indicates a condition rich of the desired average post catalyst HEGO control setting. Similarly, the lowest HEGO voltage between the HEGO sensor signal 309 and the desired average post catalyst HEGO control setting 308 may by output as HEGO lean side amplitude when HEGO signal 309 indicates a condition lean of the desired average post catalyst HEGO control setting.

In this way, the base engine air-fuel ratio for catalyst stimulation may be measured via the post catalyst HEGO signal 309 and the desired average post catalyst HEGO control setting 308. Further, the frequency, duty cycle, and amplitude of the base engine air-fuel ratio for catalyst stimulation may be derived from the post catalyst HEGO signal 309.

Referring now to FIG. 4, a flowchart of an example engine air-fuel control method is shown. The method of FIG. 4 is executable via instructions of controller 12 of FIG. 1.

At 402, method 400 judges whether or not to enable closed-loop fuel control. In one example, closed-loop fuel control may begin after the engine reaches a predetermined temperature or after the engine has been operating for a predetermined amount of time after an engine stop. If method 400 judges that conditions are present to enter closed-loop fuel control, method 400 proceeds to 404.

At 404, method 400 determines desired engine air-fuel ratio and desired base engine air-fuel ratio for catalyst stimulation. In one example, the base engine air-fuel ratio is stored in a table indexed by engine speed and load. The table is comprised of empirically determined air-fuel ratios that are suited for different engine speeds and loads. The engine speed and load may be the basis for determining an exhaust flow rate through the catalyst. Thus, the desired engine air-fuel ratio and the desired base engine air-fuel ratio for catalyst stimulation may be responsive to an exhaust flow rate through the catalyst. The base engine air-fuel ratio extracted from the table may be adjusted for engine temperature.

Similarly, the desired base engine air-fuel ratio for catalyst stimulation may be determined. In one example, engine speed and load index two tables. The first table contains different frequencies for adjusting engine air-fuel ratio to stimulate the catalyst. The second table contains different duty cycles for adjusting engine air-fuel ratio. The combination of the output of the first table and the second table is an engine air-fuel modulation signal having a frequency and duty cycle. The desired base engine air-fuel ratio for catalyst stimulation may be further adjusted for catalyst temperature and fuel type. In one example, the base engine air-fuel ratio for catalyst stimulation frequency is increased and the duty cycle is lowered as catalyst temperature decreases. The higher frequency and lower duty cycle account for less available oxygen storage within the catalyst is cooler.

In some examples, the frequency for the desired base engine air-fuel ratio is higher than the frequency for the desired base engine air-fuel ratio for catalyst stimulation. Thus, different parts of the engine system may desire different frequencies at different times during engine operation. For example, during a cold start the desired base engine air-fuel ratio and the desire engine air-fuel ratio for catalyst stimulation may have the same frequency request. At higher catalyst temperatures when oxygen storage is available, the frequency of the base engine air-fuel ration for catalyst stimulation may be lower than the frequency of the desired base engine air-fuel ratio.

Additional adjustments to the desired base engine air-fuel ratio for catalyst stimulation may be provided for particulate filter regeneration and intended engine stopping and starting. In one example, the lean portion of the duty cycle can be increased in response to an impending regeneration of a particulate filter. Thus, the state of the catalyst can be adjusted before particulate filter regeneration is initiated so that conversion efficiency of the catalyst is improved during particulate filter regeneration. In addition, the lean portion of the duty cycle for engine air-fuel ratio for catalyst stimulation can be increased during particulate filter regeneration to promote catalyst efficiency and oxidation of particulate matter within the particulate filter. In other examples, the frequency and/or amplitude of the engine air-fuel ratio for catalyst stimulation may also be adjusted in response to particulate filter regeneration.

In yet another example, frequency and duty cycle may be adjusted in response to a request to automatically start or stop the engine (e.g., where the driver takes no specific action to stop the engine; the driver may apply brakes or release an accelerator pedal but where the operator does not actively request an engine stop via a switch or command whose sole purpose is to stop the engine). In one example, the rich portion of the duty cycle is increased in response to an automatic request to stop the engine. During operator requested engine stops no such action is taken. Method 400 proceeds to 406 after the desired engine air-fuel ratio and the desired base engine air-fuel ratio for catalyst stimulation are determined.

At 406, method 400 updates the desired engine air-fuel ratio and the engine air-fuel ratio for catalyst stimulation. Method 400 accesses catalyst stimulus information as determined from a post catalyst oxygen sensor during a previous execution of the method 400. For example, catalyst stimulation information from 412 is used to update the desired engine air-fuel ratio for catalyst stimulation.

In one example, the frequency, duty cycle, and amplitude determined via a post catalyst oxygen sensor are subtracted from the desired frequency, duty cycle, and amplitude of the desired base engine air-fuel ratio for catalyst stimulation to provide error terms for engine air-fuel ratio for catalyst stimulation frequency, duty cycle, and amplitude. The error terms are multiplied by gains and then added to the base engine air-fuel ratio and the base engine air-fuel ratio for catalyst stimulation. Method 400 proceeds to 408 after the base engine air-fuel ratio and the base engine air-fuel ratio for catalyst stimulation are updated.

At 408, the base engine air-fuel ratio and the base engine air-fuel ratio for catalyst stimulation are output to the engine. In one example, the mass of air flowing into the engine is divided by the summation of the base engine air-fuel ratio and the base engine air-fuel ratio for catalyst stimulation to determine a fuel mass to be injected to engine cylinders. The fuel mass is converted into a fuel injector turn on time and the engine fuel injectors are activated for the turn on time. In this way, the engine air fuel supplied to the engine is adjusted. Consequently, each of the frequency, duty cycle, and amplitude of the engine air-fuel ratio catalyst stimulation can be adjusted independently adjusted of the other parameters. Method 400 proceeds to 410 after the engine air-fuel ratio is output.

At 410, output voltages of oxygen sensors in the engine exhaust system are read. In one example, the oxygen sensors are located as shown in FIG. 1. The oxygen sensor voltages may be sampled based on engine position or based on a time interval. During some operating conditions reading of the oxygen sensors may be delayed until predetermined conditions are met so as to delay adjustment of the engine air-fuel ratio for catalyst stimulation. For example, when a catalyst and oxygen sensor are cold, the oxygen sensor may not be read until the oxygen sensor reaches a predetermined temperature. Method 400 proceeds to 412 after output voltages of the exhaust gas oxygen sensors are determined.

At 412, method 400 determines catalyst stimulation feedback for correcting the engine air-fuel ratio for catalyst stimulation. In one example, catalyst stimulation is determined via processing the output of an oxygen sensor positioned downstream of a catalyst. If the output voltage of the oxygen sensor is greater than a desired post catalyst oxygen sensor voltage, the processed oxygen sensor voltage signal indicates a rich condition. If the output voltage of the oxygen sensor is less than the desired post catalyst oxygen sensor voltage, the processed oxygen sensor voltage signal indicates a lean condition. The time between rich or lean conditions may be used to determine the frequency of the engine air-fuel for catalyst stimulation at the catalyst. The time that the HEGO sensor is rich or lean of a desired average post catalyst HEGO control setting is the basis for determining the rich or lean duty cycle of the catalyst stimulation. The description of FIG. 3 provides example signals and procedures for determining duty cycle, frequency, and amplitude of catalyst stimulation for correcting engine air-fuel for catalyst stimulation. Method 400 proceeds to 414 after feedback for catalyst stimulation is determined from post catalyst oxygen sensors.

At 414, catalyst stimulation error is determined. In one example, catalyst stimulation error is determined by subtracting feedback from catalyst stimulation as determined at 412 from desired engine air-fuel ratio and from desired air-fuel for catalyst stimulation. For example, duty cycle error can be determined from PCHEGO_DC_Err=Desired_PCHS_DC-PCHEGO_DC_avg where PCHEGO_DC_Err is the post catalyst HEGO duty cycle error, Desired_PCHS_DC is the desired post catalyst HEGO duty cycle, and PCHEGO_DC_avg is an average of rich or lean duty cycles over a time interval or over an engine cycle interval. Similarly, frequency error can be determined from PCHEGO_Frq_Err=Desired_PCHS_Frq-PCHEGO_Frq_avg where PCHEGO_Frq_Err is the post catalyst HEGO frequency error, Desired_PCHS_Frq is the desired post catalyst HEGO frequency, and PCHEGO_Frq_avg is an average catalyst stimulation frequency over a time interval or an engine cycle interval. The error parameters determined at 414 are used by method 400 at 406 when method 400 is subsequently executed again. Method 400 exits after the catalyst stimulation error is determined.

In this way, information from a post catalyst oxygen sensor is the basis for correcting engine air-fuel ratio for catalyst stimulation. Method 400 provides for individual adjustments to engine air-fuel ratio for catalyst stimulation for duty cycle, frequency, and amplitude. As such, method 400 isolates and individually adjusts engine air-fuel ratio for catalyst stimulation with respect to duty cycle, frequency, and amplitude.

Thus, method 400 provides for adjusting an air-fuel ratio of an engine, comprising: adjusting a frequency and duty cycle of an air-fuel ratio applied to engine cylinders based on a duty cycle and frequency derived from an oxygen sensor positioned downstream of a catalyst. In this way, the engine air-fuel ratio is adjusted to stimulate higher conversion efficiency in a catalyst. The method further comprises adjusting the air-fuel ratio applied to the engine cylinders via an engine feed gas oxygen concentration and can decrease amplitude and decrease duty cycle of air-fuel applied to engine cylinders as catalyst degradation increases and oxygen storage capacity decreases. In one example, the method includes where a first gain is applied to the duty cycle of the signal derived from the oxygen sensor positioned downstream of the catalyst when the engine combusts gasoline, and where a second gain is applied to the duty cycle of the signal derived from the oxygen sensor positioned downstream of the catalyst when the engine combusts alcohol or a mixture of gasoline and alcohol. The method also includes where a first gain is applied to the frequency of the signal derived from the oxygen sensor positioned downstream of the catalyst when the engine combusts gasoline, and where a second gain is applied to the frequency of the signal derived from the oxygen sensor positioned downstream of the catalyst when the engine combusts alcohol or a mixture of gasoline and alcohol. The method also includes where a duty cycle error and a desired frequency error is determined from a desired duty cycle, a desired frequency, and the duty cycle and the frequency of a signal derived from the oxygen sensor positioned downstream of the catalyst. The method also includes where the desired duty cycle and the desired frequency are adjusted in response to a temperature of the catalyst. The method further includes where the desired duty cycle and desired frequency are adjusted in response to a flow rate through the catalyst.

In another example, method 400 provides for a method for adjusting an air-fuel ratio of an engine, comprising: supplying an air-fuel to the engine at a first duty cycle and a first frequency; and adjusting the first duty cycle and the first frequency via a second frequency and a second duty cycle, the second frequency lower than the first frequency, the second duty cycle responsive to an output of an oxygen sensor positioned downstream of a catalyst in an exhaust system of the engine. The method includes where the first duty cycle is adjusted based on an error between a desired post catalyst duty cycle and the second duty cycle. The method also includes where the desired post catalyst duty cycle is adjusted in response to a state of a particulate filter. The method also includes where the second duty cycle is determined from an output voltage of the oxygen sensor referenced to a desired post catalyst oxygen sensor voltage. The method includes where the desired post catalyst oxygen sensor voltage is adjusted responsive to engine operating conditions. The method also includes where the desired post catalyst oxygen sensor voltage is adjusted responsive to catalyst operating conditions. The method includes where the second frequency increases as engine speed increases.

As will be appreciated by one of ordinary skill in the art, routines described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A system for adjusting an engine air-fuel ratio, comprising:

a first oxygen sensor positioned in an exhaust passage of an engine;

a catalyst positioned in the exhaust passage of the engine;

a second oxygen sensor positioned in the exhaust passage downstream of the catalyst; and a controller, the controller including instructions to adjust an air-fuel ratio of the engine responsive to a duty cycle and frequency of an output of the second oxygen sensor, the duty cycle and frequency output of the second oxygen sensor based on a desired post catalyst oxygen sensor voltage.

2. The system of claim 1, further comprising a particulate filter positioned in the exhaust system.

3. The system of claim 1, further comprising additional controller instructions to adjust the desired post catalyst oxygen sensor voltage based on engine operating conditions.

4. The system of claim 3, where the additional controller instructions include increasing the desired post catalyst oxygen sensor voltage in response to increasing engine load.

5. The system of claim 1, further comprising additional controller instructions for a first mode where engine air-fuel is not adjusted in response to the second oxygen sensor and a second mode where engine air-fuel is adjusted in response to the second oxygen sensor.

6. The system of claim 5, where the second mode is a closed-loop fuel control mode, and further comprising additional controller instructions for delaying adjusting the air-fuel ratio of the engine in response to the second oxygen sensor and in response to a temperature of the catalyst.

7. A method for adjusting an air-fuel ratio of an engine, comprising:

adjusting a frequency and duty cycle of an air-fuel ratio applied to engine cylinders based on a duty cycle and frequency derived from an oxygen sensor positioned downstream of a catalyst.

8. The method of claim 7, further comprising adjusting the air-fuel ratio applied to the engine cylinders via an engine feed gas oxygen concentration, and further comprising decreasing an amplitude and decreasing a duty cycle of the air-fuel applied to engine cylinders as catalyst degradation increases and catalyst oxygen storage capacity decreases.

9. The method of claim 7, where a first gain is applied to the duty cycle of the signal derived from the oxygen sensor positioned downstream of the catalyst when the engine combusts gasoline, and where a second gain is applied to the duty cycle of the signal derived from the oxygen sensor positioned downstream of the catalyst when the engine combusts alcohol or a mixture of gasoline and alcohol.

10. The method of claim 7, where a first gain is applied to the frequency of the signal derived from the oxygen sensor positioned downstream of the catalyst when the engine combusts gasoline, and where a second gain is applied to the frequency of the signal derived from the oxygen sensor positioned downstream of the catalyst when the engine combusts alcohol or a mixture of gasoline and alcohol.

11. The method of claim 7, where a duty cycle error and a desired frequency error is determined from a desired duty cycle, a desired frequency, and the duty cycle and the frequency of a signal derived from the oxygen sensor positioned downstream of the catalyst.

12. The method of claim 11, where the desired duty cycle and the desired frequency are adjusted in response to a temperature of the catalyst.

13. The method of claim 12, where the desired duty cycle and desired frequency are adjusted in response to a flow rate through the catalyst.

14. A method for adjusting an air-fuel ratio of an engine, comprising:

supplying an air-fuel to the engine at a first duty cycle and a first frequency; and adjusting the first duty cycle and the first frequency via a second frequency and a second duty cycle, the second frequency lower than the first frequency, the second duty cycle responsive to an output of an oxygen sensor positioned downstream of a catalyst in an exhaust system of the engine.

15. The method of claim 14, where the first duty cycle is adjusted based on an error between a desired post catalyst duty cycle and the second duty cycle.

16. The method of claim 15, where the desired post catalyst duty cycle is adjusted in response to a state of a particulate filter.

17. The method of claim 15, where the second duty cycle is determined from an output voltage of the oxygen sensor referenced to a desired post catalyst oxygen sensor voltage.

18. The method of claim 17, where the desired post catalyst oxygen sensor voltage is adjusted responsive to engine operating conditions.

19. The method of claim 17, where the desired post catalyst oxygen sensor voltage is adjusted responsive to catalyst operating conditions.

20. The method of claim 15, where the second frequency increases as engine speed increases.

* * * * *